US007760176B2

(12) United States Patent
Toeda et al.

(10) Patent No.: US 7,760,176 B2
(45) Date of Patent: Jul. 20, 2010

(54) METHOD AND APPARATUS FOR TIME-DIVISIONAL DISPLAY PANEL DRIVE

(75) Inventors: Masahiro Toeda, Kawasaki (JP); Takashi Nose, Kawasaki (JP)

(73) Assignee: NEC Electronics Corporation, Kanagawa (JP)

( * ) Notice: Subject to any disclaimer, the term of this patent is extended or adjusted under 35 U.S.C. 154(b) by 1186 days.

(21) Appl. No.: 11/070,091

(22) Filed: Mar. 3, 2005

(65) Prior Publication Data

US 2005/0195143 A1 Sep. 8, 2005

(30) Foreign Application Priority Data

Mar. 3, 2004 (JP) ..... 2004-059750

(51) Int. Cl.
*G09G 3/36* (2006.01)

(52) U.S. Cl. ..... 345/88; 345/87; 345/90

(58) Field of Classification Search ..... 345/87, 345/88, 90
See application file for complete search history.

(56) References Cited

U.S. PATENT DOCUMENTS

| | | | | |
|---|---|---|---|---|
| 5,142,388 | A * | 8/1992 | Watanabe et al. | 349/69 |
| 6,181,311 | B1 * | 1/2001 | Hashimoto | 345/98 |
| 6,259,504 | B1 * | 7/2001 | Shin et al. | 349/144 |
| 6,392,631 | B1 | 5/2002 | Bertin et al. | |
| 6,462,801 | B2 * | 10/2002 | Shin et al. | 349/144 |
| 6,476,779 | B1 | 11/2002 | Yano et al. | |
| 6,741,227 | B2 * | 5/2004 | Naka et al. | 345/72 |
| 6,809,717 | B2 * | 10/2004 | Asao et al. | 345/102 |
| 7,002,539 | B2 * | 2/2006 | Shimada | 345/88 |
| 7,015,994 | B2 * | 3/2006 | Cho et al. | 349/109 |
| 7,071,906 | B2 * | 7/2006 | Nishitani et al. | 345/81 |
| 7,091,937 | B2 | 8/2006 | Nakamura | |
| 7,196,968 | B2 | 3/2007 | Okuno et al. | |
| 7,209,111 | B2 * | 4/2007 | Kurokawa et al. | 345/99 |
| 7,250,926 | B2 * | 7/2007 | Suzuki et al. | 345/74.1 |
| 7,532,184 | B2 * | 5/2009 | Koo et al. | 345/88 |
| 7,545,394 | B2 * | 6/2009 | Nose et al. | 345/690 |
| 2003/0090451 | A1 * | 5/2003 | Ahn | 345/96 |
| 2003/0107538 | A1 * | 6/2003 | Asao et al. | 345/87 |
| 2003/0142048 | A1 * | 7/2003 | Nishitani et al. | 345/82 |
| 2004/0021677 | A1 * | 2/2004 | Sasaki et al. | 345/694 |
| 2004/0115851 | A1 * | 6/2004 | Tanaka et al. | 438/30 |
| 2004/0135149 | A1 * | 7/2004 | Cho et al. | 257/72 |

(Continued)

FOREIGN PATENT DOCUMENTS

| | | |
|---|---|---|
| JP | 11-244956 | 12/1999 |

(Continued)

OTHER PUBLICATIONS

Japanese Patent Office issued a Japanese Office Action dated Jan. 19, 2010, Application No. 2004-059750.

*Primary Examiner*—Bipin Shalwala
*Assistant Examiner*—Afroza Y Chowdhury
(74) *Attorney, Agent, or Firm*—Young & Thompson

(57) ABSTRACT

A method is provided for driving a display device including first to p-th pixels associated with different colors with p being integers equal to or more than three. The method is composed of a step of time-divisionally driving the first to p-th pixels. In the time-divisionally driving, the pixel associated with the color exhibiting the lowest spectral luminous efficacy among the colors is firstly driven.

19 Claims, 6 Drawing Sheets

U.S. PATENT DOCUMENTS

| | | | | |
|---|---|---|---|---|
| 2004/0135938 | A1* | 7/2004 | Choi | 349/108 |
| 2004/0207584 | A1* | 10/2004 | Koo et al. | 345/82 |
| 2004/0212633 | A1* | 10/2004 | Natori et al. | 345/694 |
| 2004/0239612 | A1* | 12/2004 | Asao et al. | 345/102 |
| 2005/0035939 | A1* | 2/2005 | Akiyama | 345/102 |
| 2005/0219276 | A1* | 10/2005 | Nose et al. | 345/690 |

FOREIGN PATENT DOCUMENTS

| | | |
|---|---|---|
| JP | 11-338438 | 12/1999 |
| JP | 2000-122627 | 4/2000 |
| JP | 2003-157051 | 5/2003 |
| JP | 2004-309949 | 11/2004 |
| JP | 2005-148314 | 6/2005 |

* cited by examiner

Fig. 3A

| | PIXEL SET $P_{i1}$ | | | PIXEL SET $P_{i2}$ | | |
|---|---|---|---|---|---|---|
| | "R" PIXEL $C_{i1}$ | "G" PIXEL $C_{i2}$ | "B" PIXEL $C_{i3}$ | "R" PIXEL $C_{i4}$ | "G" PIXEL $C_{i5}$ | "B" PIXEL $C_{i6}$ |
| LINE n | 3 | 5 | 1 | 4 | 6 | 2 |
| LINE n+1 | 4 | 6 | 2 | 3 | 5 | 1 |

Fig. 3B

| | PIXEL SET $P_{i1}$ | | | PIXEL SET $P_{i2}$ | | |
|---|---|---|---|---|---|---|
| | "R" PIXEL $C_{i1}$ | "G" PIXEL $C_{i2}$ | "B" PIXEL $C_{i3}$ | "R" PIXEL $C_{i4}$ | "G" PIXEL $C_{i5}$ | "B" PIXEL $C_{i6}$ |
| LINE n | 2 | 5 | 1 | 4 | 6 | 3 |
| LINE n+1 | 4 | 6 | 3 | 2 | 5 | 1 |

Fig. 3C

| | PIXEL SET $P_{i1}$ | | | PIXEL SET $P_{i2}$ | | |
|---|---|---|---|---|---|---|
| | "R" PIXEL $C_{i1}$ | "G" PIXEL $C_{i2}$ | "B" PIXEL $C_{i3}$ | "R" PIXEL $C_{i4}$ | "G" PIXEL $C_{i5}$ | "B" PIXEL $C_{i6}$ |
| LINE n | 2 | 3 | 1 | 5 | 6 | 4 |
| LINE n+1 | 5 | 6 | 4 | 2 | 3 | 1 |

Fig. 4A

FRAME m

| | PIXEL SET $P_{i1}$ | | | PIXEL SET $P_{i2}$ | | |
|---|---|---|---|---|---|---|
| | "R" PIXEL $C_{i1}$ | "G" PIXEL $C_{i2}$ | "B" PIXEL $C_{i3}$ | "R" PIXEL $C_{i4}$ | "G" PIXEL $C_{i5}$ | "B" PIXEL $C_{i6}$ |
| LINE n | 3 | 5 | 1 | 4 | 6 | 2 |
| LINE n+1 | 4 | 6 | 2 | 3 | 5 | 1 |

Fig. 4B

FRAME m+1

| | PIXEL SET $P_{i1}$ | | | PIXEL SET $P_{i2}$ | | |
|---|---|---|---|---|---|---|
| | "R" PIXEL $C_{i1}$ | "G" PIXEL $C_{i2}$ | "B" PIXEL $C_{i3}$ | "R" PIXEL $C_{i4}$ | "G" PIXEL $C_{i5}$ | "B" PIXEL $C_{i6}$ |
| LINE n | 4 | 6 | 2 | 3 | 5 | 1 |
| LINE n+1 | 3 | 5 | 1 | 4 | 6 | 2 |

Fig. 5A

FRAME m

| | PIXEL SET $P_{i1}$ | | | PIXEL SET $P_{i2}$ | | |
|---|---|---|---|---|---|---|
| | "R" PIXEL $C_{i1}$ | "G" PIXEL $C_{i2}$ | "B" PIXEL $C_{i3}$ | "R" PIXEL $C_{i4}$ | "G" PIXEL $C_{i5}$ | "B" PIXEL $C_{i6}$ |
| LINE n | 2 | 5 | 1 | 4 | 6 | 3 |
| LINE n+1 | 4 | 6 | 3 | 2 | 5 | 1 |

Fig. 5B

FRAME m+1

| | PIXEL SET $P_{i1}$ | | | PIXEL SET $P_{i2}$ | | |
|---|---|---|---|---|---|---|
| | "R" PIXEL $C_{i1}$ | "G" PIXEL $C_{i2}$ | "B" PIXEL $C_{i3}$ | "R" PIXEL $C_{i4}$ | "G" PIXEL $C_{i5}$ | "B" PIXEL $C_{i6}$ |
| LINE n | 4 | 6 | 3 | 2 | 5 | 1 |
| LINE n+1 | 2 | 5 | 1 | 4 | 6 | 3 |

Fig. 6A

FRAME m

| | PIXEL SET $P_{i1}$ | | | PIXEL SET $P_{i2}$ | | |
|---|---|---|---|---|---|---|
| | "R" PIXEL $C_{i1}$ | "G" PIXEL $C_{i2}$ | "B" PIXEL $C_{i3}$ | "R" PIXEL $C_{i4}$ | "G" PIXEL $C_{i5}$ | "B" PIXEL $C_{i6}$ |
| LINE n | 2 | 3 | 1 | 5 | 6 | 4 |
| LINE n+1 | 5 | 6 | 4 | 2 | 3 | 1 |

Fig. 6B

FRAME m+1

| | PIXEL SET $P_{i1}$ | | | PIXEL SET $P_{i2}$ | | |
|---|---|---|---|---|---|---|
| | "R" PIXEL $C_{i1}$ | "G" PIXEL $C_{i2}$ | "B" PIXEL $C_{i3}$ | "R" PIXEL $C_{i4}$ | "G" PIXEL $C_{i5}$ | "B" PIXEL $C_{i6}$ |
| LINE n | 5 | 6 | 4 | 2 | 3 | 1 |
| LINE n+1 | 2 | 3 | 1 | 5 | 6 | 4 |

METHOD AND APPARATUS FOR TIME-DIVISIONAL DISPLAY PANEL DRIVE

BACKGROUND OF THE INVENTION

1. Field of the Invention

The present invention generally relates to methods and apparatuses for driving display panels. More specifically, the present invention relates to methods and apparatuses adapted to drive signal lines within display panels in a time divisional manner.

2. Description of the Related Art

Recent display panels are composed of an increased number of signal lines (or data lines) with reduced intervals therebetween; this is a basic requirement for high-resolution display panels. The increase in the number of signal lines and/or the reduction in the intervals thereof, however, undesirably cause a problem in providing electrical connection between the display panel and the display panel driver with external wiring lines. The reduction in the intervals of the signal lines undesirably reduce pitches allowed to the external connecting wiring lines, so that the display panel experiences a difficulty in achieving electrical connection to the display panel driver. Another problem caused by the increase in the number of data lines is an undesirable increase in the number of amplifiers used for driving data lines. The increase in the number of the amplifiers undesirably increases the size and cost of the display panel driver.

Time-divisional driving, which involves driving signal lines within the display panel in a time-divisional manner, is one of the promising techniques for overcoming such problems. Japanese Laid-open Patent Application No. H04-52684, for instance, discloses a liquid crystal display device in which each set of three data lines are switched by a switching circuitry disposed within a liquid crystal display panel for achieving time-divisional driving of each three signal lines.

FIG. 1 is a block diagram for schematically showing the known liquid crystal display device. This liquid crystal display device is designed to drive each set of three signal lines with a single amplifier in a time divisional manner.

Specifically, the conventional liquid crystal display device is provided with a liquid crystal display panel 10 and a driver 20. The liquid crystal display panel 10 is equipped with signal lines "$D_1$" to "$D_3$,", scan lines (or gate lines) "$G_1$" to "$G_M$", and pixels "$C_{11}$" to "$C_{M3}$", being a natural number equal to or larger than 2; it should be understood that all of the components within the liquid crystal display panel 10 are not shown for simplicity. The signal lines $D_1$ to $D_3$ are associated with red (R), green (G) and blue (B), respectively. The pixels $C_{11}$ to $C_{M3}$ are provided at respective intersections of the signal lines $D_1$ to $D_3$ and the scan lines $G_1$ to $G_M$. Each of the pixels $C_{11}$ to $C_{M3}$ is equipped with a TFT (thin-film transistor) 11 and a liquid crystal capacitor 12. The liquid crystal capacitors 12 are each constituted by a set of pixel electrode 12*a* and a common electrode 12*b* spaced with liquid crystal material. The TFT 11 within the pixel "$C_{ij}$" has a source connected to the signal "$D_i$", a gate connected to the scan line "$G_j$", and a drain connected to the pixel electrode 12*a* of the liquid crystal capacitor 12.

The respective signal lines $D_1$ to $D_3$ are connected with an input terminal 14 through switches $\mathbf{13}_1$ to $\mathbf{13}_3$. The switches $\mathbf{13}_1$ to $\mathbf{13}_3$ are each composed of one or more TFTs disposed within the liquid crystal display panel 10. The switches $\mathbf{13}_1$ to $\mathbf{13}_3$ are turned on and off in response to control signals "$S_1$" to "$S_3$" received from the driver 20. The input terminals 14 receive drive voltages from the driver 20, which are to be applied to the pixels $C_{11}$ to $C_{M3}$. It should be noted that the drive voltage to be applied to the pixel "$C_{ij}$" may be referred to as the drive voltage "$V_{ij}$" in the following. The switches $\mathbf{13}_1$ to $\mathbf{13}_3$ are sequentially switched to forward the drive voltages to the desired signal lines D1 to D3.

The driver 20 is provided with a shift register 21, a data register 22, a latch circuit 23, a D/A converter 24, and a set of amplifiers 25. The shift register 21 shifts data bits therethrough in response to an externally inputted clock signal "CLK" so as to produce a set of shift pulses. The data register 22 is designed to latch RGB pixel data representative of grayscale levels of the pixels within the display panel 10, using the shift pulses as triggers. The latch circuit 23 is designed to latch the RGB data from the data register 22, and to forward the latched RGB data to the D/A converter 24. The D/A converter 24 externally receives a set of grayscale voltages, and selects desired ones of the grayscale voltages in response to the forwarded RGB data. The selected grayscale voltages are sequentially supplied to the associated amplifiers 25. The amplifiers 25 develop drive voltages corresponding to the grayscale voltages received from the D/A converter 24 on the associated input terminals 14 of the liquid crystal display panel 10.

The driver 20 is further equipped with a control circuit 26 that produces control signals "$S_1$" to "$S_3$." The control circuit 26 supplies the control signals $S_1$ to $S_3$ to the switches $\mathbf{13}_1$ to $\mathbf{13}_3$ to selectively turn on desired one of the switches $\mathbf{13}_1$ to $\mathbf{13}_3$. The control circuit 26 additionally provides timing control so that the amplifiers 25 develop the drive voltages on the input terminals 14 in synchronization with the timing of the control signals $S_1$ to $S_3$. The on/off timing control of the switches $\mathbf{13}_1$ to $\mathbf{13}_3$ is important for a desired drive voltage is applied to a desired signal line in synchronization with the development of the drive voltage on the desired input terminal 14. The control circuit 26 executes the above-described timing control in accordance with a program stored in a storage device (not shown) within the driver 20.

Writing the drive voltages "$V_{n1}$" to "$V_{n3}$" into the pixels "$C_{n1}$" to "$C_{n3}$", positioned in the n-th pixel line of the display panel 10, is exemplarily carried out during the n-th horizontal scanning period as follows.

First, the scan line "$G_n$", connected to the pixels $C_{n1}$ to $C_{n3}$ in the n-th pixel line, is activated to turn on the TFTs 11 within the pixels $C_{n1}$ to $C_{n3}$. This provides electrical connections between the pixels $C_{n1}$ to $C_{n3}$ and the associated signal lines $D_1$ to $D_3$.

The drive voltages $V_{n1}$, associated with the pixels $C_{n1}$, are applied from the associated amplifiers 25 to the associated input terminals 14. In synchronization with the input of the drive voltages $V_{n1}$, the switches $\mathbf{13}_1$ are turned on, while the remaining switches $\mathbf{13}_2$ and $\mathbf{13}_3$ are turned off. As a result, the signal lines $D_1$ are connected to the associated input terminals 14, and the remaining signal lines $D_2$ and $D_3$ are disconnected from the input terminals 14. The drive voltages $V_{n1}$ are applied through the signal lines $D_1$ to the associated pixels $C_{n1}$, and are then written into the pixels $C_{n1}$. This results in that the drive voltages $V_{n1}$ are developed across the associated liquid crystal capacitors within the pixels $C_{n1}$).

Subsequently, the drive voltages $V_{n2}$ associated with the pixels $C_{n2}$ are applied from the amplifier 25 to the input terminal 14. In synchronism with the input of the drive voltages $V_{n2}$, the switches $\mathbf{13}_2$ are turned on, and the remaining switches $\mathbf{13}_1$ and $\mathbf{13}_3$ are turned off. As a result, the input terminals 14 are connected to the signal lines $D_2$, and the drive voltages $V_{n2}$ are written via the signal lines $D_2$ to the associated pixels $C_{n2}$.

Correspondingly, the drive voltages $V_{n3}$, associated with the pixels $C_{n3}$, are applied from the amplifiers 25 to the associated input terminals 14. In synchronism with the input of the drive voltages $V_{n3}$, the switches $\mathbf{13}_3$ are turned on, and the remaining switches $\mathbf{13}_1$ and $\mathbf{13}_2$ are turned off. As a result, the input terminals 14 are connected to the signal lines $D_3$, and the drive voltages $V_{n3}$ are written via the signal lines $D_3$ to the associated pixels $C_{n3}$.

In accordance with the above-described sequence, each set of the signal lines $D_1$ to $D_3$ are time-divisionally driven by the associated single amplifier 25, so that the drive voltages $V_{n1}$ to $V_{n3}$ are written into the associated pixels $C_{n1}$ to $C_{n3}$. Driving the pixels $C_{n1}$ to $C_{n3}$ are performed in this order of the pixels $C_{n1}$, $C_{n2}$, and $C_{n3}$.

The above-described patent publication also discloses that the signal lines may not be associated with R, G, and B, and the number of signal lines driven by a single amplifier may be two, four, or more. In addition, Japanese Laid-open Patent Application No. 2001-109435 discloses a technique for switching each two signal lines by a selecting circuit within a display panel. Also, Japanese Laid-open patent Application No. 2001-337657 discloses that a set of six signal lines are switched by the six analog switches within a display panel.

One problem of the conventional time-divisional driving technique is that the drive voltages developed across the liquid crystal capacitors 12 may vary from the desirable drive voltages, after the associated signal lines are disconnected from the input terminals 14.

There are three possible causes for the voltage variation across the liquid crystal capacitors 12. The first cause may be that the TFTs within the switches $\mathbf{13}_1$ to $\mathbf{13}_3$ experience considerable leakage therethrough. Referring now to FIG. 1, the TFTs within the switches $\mathbf{13}_1$ to $\mathbf{13}_3$ are required to have an increased gate width and a decreased gate length for rapidly driving the signal lines $D_1$ to $D_3$, which have an increased length and increased capacitance. Such designed TFTs, however, often suffer from considerable leakage. The leakage through the switches $\mathbf{13}_1$ to $\mathbf{13}_3$ provide discharge paths for the charges accumulated on the pixel electrodes 12*a* within the respective pixels. This results in undesirable variation in the drive voltages across the pixels. The leakage through the switches $\mathbf{13}_1$ to $\mathbf{13}_3$ may be serious, especially in the case when adjoining signal lines are driven with largely different drive voltages.

The second cause may be related to capacitive couplings between signal lines, as disclosed in the aforementioned Japanese Laid-open Patent Application No. 2001-109435. For example, driving the signal, lines $D_2$ may cause variation in the voltages on the signal lines $D_1$ after the signal lines $D_1$ are placed into the high impedance state, due to the capacitive coupling between the signal lines $D_1$ and $D_2$. The variation in the voltages of the signal lines $D_1$ may cause variation in the drive voltages across the pixels connected to the signal lines $D_1$.

The third cause may be related to variation in the common voltage developed on the common electrode 12*b*, which is referred to as the common voltage $V_{COM}$. The common voltage $V_{COM}$ is required to be stable during driving the pixels for developing desired drive voltages across the desired pixels; however, the common voltage $V_{COM}$ may vary due to various reasons, including capacitive couplings between the common electrode 12*b* and other conductors, and the leakage from the common electrode 12*b*. The variation in the common voltage $V_{COM}$ may cause the variation of the drive voltages across the pixels from desired voltages.

Such drive voltage variations are undesirably recognized by human eyes as vertical segments of uneven brightness, extending along the signal lines $D_1$ to $D_3$. The variations in the drive voltages may give undesirable influences to image qualities of the liquid crystal display panel 10.

The increase in the number of the signal lines driven with a single amplifier undesirably enhances the variations of the drive voltages. Therefore, the variations in the drive voltages is one of the major factors which impede commercial use of next-generation liquid crystal display panels designed to time-divisionally drive a set of six signal lines using a single amplifier.

The above-described Japanese Laid-open Patent Application No. 2001-109435 also discloses a display device adapted to drive each pair of signal lines with a single amplifier in which the order of driving the pair of the signal lines is switched every vertical scanning period and/or every horizontal scanning period. This technique is effective for spatially or temporally distributing pixels experiencing the variations of the drive voltages, and thereby eliminating undesirable vertical segments of uneven brightness.

SUMMARY OF THE INVENTION

In an aspect of the present invention, a method is provided for driving a display device including first to p-th pixels associated with different colors with p being integers equal to or more than three. The method is composed of a step of time-divisionally driving the first to p-th pixels. In the time-divisionally driving, the pixel associated with the color exhibiting the lowest spectral luminous efficacy among the colors is firstly driven.

This method effectively reduces vertical segments of uneven brightness, because the firstly-driven pixel, which experiences considerable variation in the drive voltage thereacross, exhibits a reduced influence on the image quality due to the low spectral luminous efficacy.

In a preferred embodiment, the first to p-th pixels are driven during a horizontal scanning period in the order from low to high spectral luminous efficacies. This achieves further improvement of the image quality.

When the first to p-th pixels includes a set of "R", "G", and "B" pixels associated with red, green, and blue, the "B" pixel is firstly driven among the "R", "G", and "B" pixels. Preferably, the "R", "G", and "B" pixels are driven in this order of the "B" pixel, the "R" pixel, and the "G" pixel.

In another aspect of the present invention, a method of driving a display device including first to p-th pixels associated with different colors with p being integers equal to or more than three, the method comprising:

time-divisionally driving the first to p-th pixels with associated drive voltages, wherein the time-divisionally driving includes finally driving selected one of the first to p-th pixels, the selected one being associated with a color exhibiting the highest spectral luminous efficacy among the colors.

When the first to p-th pixels includes a set of "R", "G", and "B" pixels associated with red, green, and blue, the "G" pixel is finally driven among the "R", "G", and "B" pixels.

In still another aspect of the present invention, a method for driving a display panel including a plurality of pixel sets each including a set of pixels associated with different colors, the method comprising:

time-divisionally driving the pixels within the plurality of pixel sets, wherein the time-divisionally driving includes firstly driving a set of pixels associated with a color exhibiting the highest spectral luminous efficacy among the colors.

In still another aspect of the present invention, a method for driving a display panel, comprising:

providing a display panel including first and second pixel lines adjoining in a vertical direction, each of the pixel lines including first and second pixel sets adjoining in a horizontal direction, and each of the first and second pixel sets comprising a plurality of pixels associated with different colors;

driving the set of pixels within the first and second pixel sets associated with the first pixel line during a first horizontal scanning period; and driving the set of pixels within the first and second pixel sets associated with the second pixel line during a second horizontal scanning period following the first horizontal scanning period, wherein selected one of the plurality of pixels is firstly driven within each of the first and second pixel sets, the selected one being associated with a color exhibiting the lowest spectral luminous efficacy among the colors, wherein, with ordering numbers defined for the plurality of pixels, the ordering numbers indicating the order of driving the plurality of pixels for each of the first and second pixel lines, orders of driving the plurality of pixels for the first and second pixel lines are determined so that the ordering numbers defined for the plurality of pixels associated with the first pixel set within the first pixel line are identical to those defined for the plurality of pixels associated with the second pixel set within the second pixel line, and ordering numbers defined for the plurality of pixels associated with the second pixel set within the first pixel line are identical to those defined for the plurality of pixels associated with the first pixel set within the second pixel line.

In still another aspect of the present invention, a method for driving a display panel, comprising:

providing a display panel including first and second pixel lines adjoining in a vertical direction, each of the pixel lines including first and second pixel sets adjoining in a horizontal direction, and each of the first and second pixel sets comprising a plurality of pixels associated with different-colors;

driving the set of pixels within the first and second pixel sets associated with the first pixel line during a first horizontal scanning period for a first frame;

driving the set of pixels within the first and second pixel sets associated with the second pixel line during a second horizontal scanning period following the first horizontal scanning period for the first frame;

driving the set of pixels within the first and second pixel sets associated with the first pixel line during a first horizontal scanning period for a second frame; and driving the set of pixels within the first and second pixel sets associated with the second pixel line during a second horizontal scanning period following the first horizontal scanning period for the second frame, wherein selected one of the plurality of pixels is firstly driven within each of the first and second pixel sets, the selected one being associated with a color exhibiting the lowest spectral luminous efficacy among the colors, wherein, with ordering numbers defined for the plurality of pixels, the ordering numbers indicating the order of driving the plurality of pixels for each of the first and second pixel lines, orders of driving the plurality of pixels within the first and second pixel lines are determined for the first frame, so that the ordering numbers defined for the plurality of pixels associated with the first pixel set within the first pixel line are identical to those defined for the plurality of pixels associated with the second pixel set within the second pixel line, and ordering numbers defined for the plurality of pixels associated with the second pixel set within the first pixel line are identical to those defined for the plurality of pixels associated with the first pixel set within the second pixel line, and wherein orders of driving the plurality of pixels within the first and second pixel lines are determined for the second frame, so that ordering numbers of the plurality of pixels within the first pixels set associated with the first pixel line are exchanged with ordering numbers of the plurality of pixels within the second pixels set associated with the first pixel line, and that ordering numbers of the plurality of pixels within the first pixels set associated with the second pixel line are exchanged with ordering numbers of the plurality of pixels within the second pixels set associated with the second pixel line.

BRIEF DESCRIPTION OF THE DRAWINGS

For a better understanding of the above-described object and other objects of the present invention, reference is made of the following detailed description of the invention to be read in conjunction with the following drawings, in which:

FIGS. 3A to 3C are tables illustrating exemplary drive sequences according to the present invention;

FIGS. 4A and 4B are tables illustrating other exemplary drive sequences according to the present invention;

FIGS. 5A and 5B are tables illustrating other exemplary drive sequences according to the present invention; and FIGS. 6A and 6B are tables illustrating other exemplary drive sequences according to the present invention.

DESCRIPTION OF THE PREFERRED EMBODIMENTS

Figure 1:
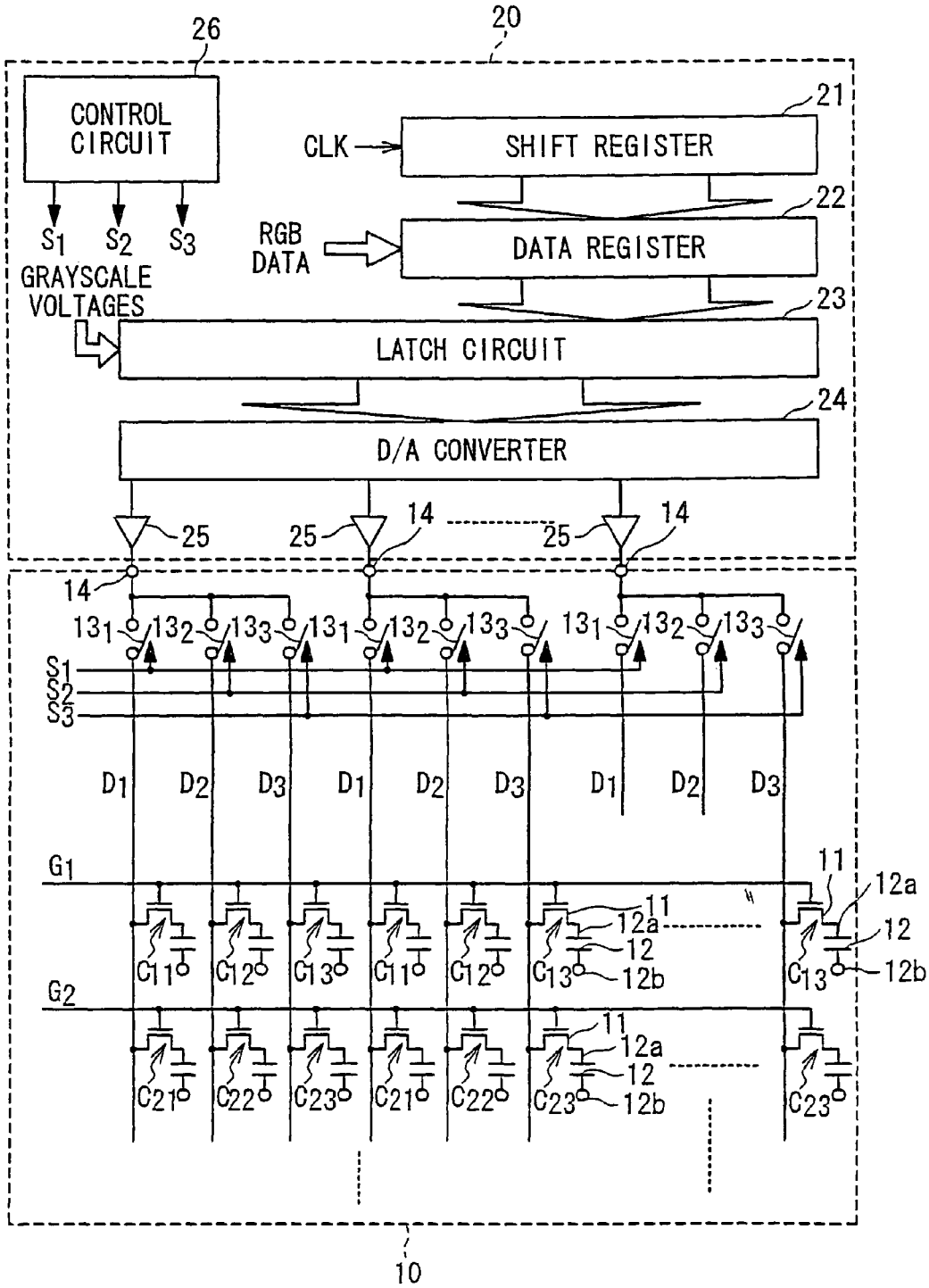
Fig. 1 (PRIOR ART)
FIG. 1 is a schematic block diagram illustrating the structure of the known display device.

Referring now to drawings, various preferred embodiments of the present invention will be described in detail. It should be noted that same reference numerals denoted same or similar components in the drawings.

Display Device Structure

Figure 2:
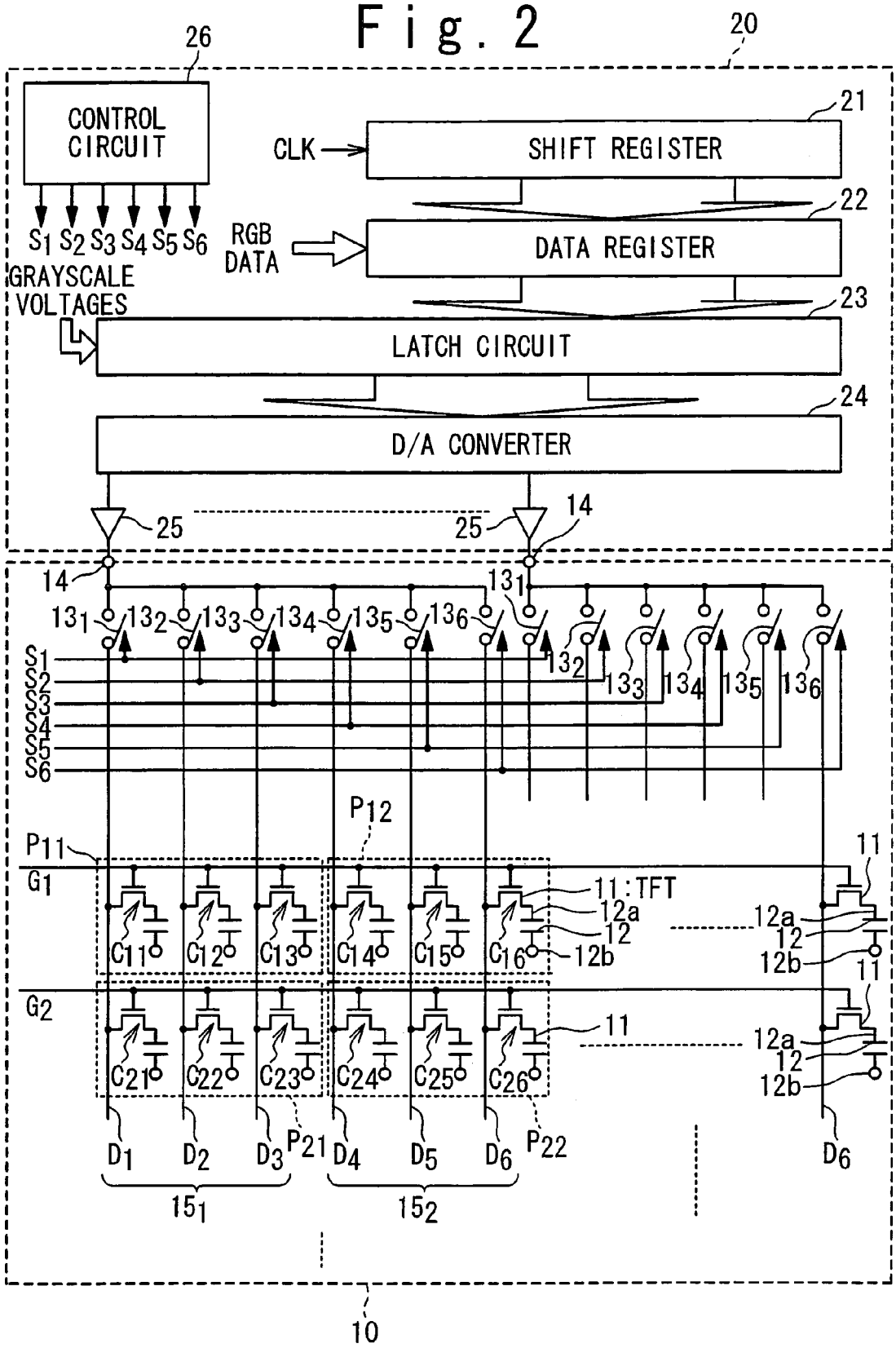
FIG. 2 is a schematic block diagram illustrating an exemplary structure of a display device according to the present invention.

In one embodiment, as shown in FIG. 2, a display panel driving method according to the present invention is applied to a display device adapted to time-divisional driving of six signal lines with a single amplifier. It should be noted that the structure of the display device shown in FIG. 2 is substantially identical to that of the display device shown in FIG. 1 except for that the number of the signal lines associated with a single amplifier is different from that of the display device shown in FIG. 1. The display device in this embodiment will be briefly described in the following.

The display device is provided with a liquid crystal display panel 10 and a driver 20. The liquid crystal display panel 10 is equipped with signal lines $D_1$ to $D_6$, scan lines $G_1$ to $G_M$, and pixels "$C_{11}$ to "$C_{M6}$ disposed at respective intersections of the signal lines $D_1$ to $D_6$ and the scan lines $G_1$ to $G_M$. Each of the pixels $C_{11}$ to $C_{M6}$ is equipped with a TFT 11 and a liquid crystal capacitor 12. The signal lines $D_1$ to $D_6$ are connected via switches $\mathbf{13}_1$ to $\mathbf{13}_6$ to input terminals 14. The switches $\mathbf{13}_1$ to $\mathbf{13}_6$ are turned on and off in response to control signals $S_1$ to $S_6$ received from the driver 20.

The liquid crystal display panel 10 is adapted to a RGB color system, in which colors are defined as mixtures of Red (R), Green (G), and Blue (B). The signal lines $D_1$ and $D_4$ are associated with Red (R), and the pixels $C_{11}$ to $C_{M1}$ and $C_{14}$ to $C_{M4}$, which are connected to the signal lines $D_1$ and $D_4$, are used for representing red; the pixels $C_{11}$ to $C_{M1}$ and $C_{14}$ to $C_{M4}$, associated with Red (R), may be referred to as "R" pixels, hereinafter. Correspondingly, the signal lines $D_2$ and $D_5$ are associated with Green (G), and the pixels $C_{12}$ to $C_{M2}$ and $C_{15}$ to $C_{M5}$, which are connected to the signal lines $D_2$ and $D_{51}$ are used for representing green; the pixels $C_{12}$ to $C_{M2}$ and $C_{15}$ to $C_{M5}$ may be may be referred to as "G" pixels, hereinafter. Finally, the signal lines $D_3$ and $D_6$ are associated with Blue (B), and the pixels $C_{13}$ to $C_{M3}$ and $C_{13}$ to $C_{M6}$, which are connected to the signal lines $D_3$ and $D_6$, are used for representing blue; the pixels $C_{13}$ to $C_{M3}$ and $C_{13}$ to $C_{M6}$ may be referred to as "B" pixels, hereinafter.

A set of six pixels that are positioned in the same pixel line (that is, in the same row) and connected to the same input terminal 14 constitute two pixel sets, each of which contains one "R" pixel, one "G" pixel, and one "B" pixel. As to pixels $C_{n1}$ to $C_{n6}$ positioned in the n-th pixel line, for instance, one "R" pixel $C_{n1}$, one "G" pixel $C_{n2}$, and one "B" pixel $C_{n3}$ constitute one pixel set $P_{n1}$, whereas one "R" pixel $C_{n4}$, one "G" pixel $C_{n5}$, and one "B" pixel $C_{n6}$ constitute another pixel set $P_{n2}$. One dot of the liquid crystal display panel 10 is composed of three pixels contained in a single pixel set, which represent the color of the associated dot as the mixture of Red (R), Green (G), and Blue (B).

Correspondingly, a set of six signal lines connected to the same input terminal 4 constitute two signal line sets, each including a set of three signal lines respectively associated with R, G, and B. Specifically, a set of signal lines $D_1$ to $D_3$ constitute a signal line set $\mathbf{15}_1$, whereas a set of signal lines $D_4$ to $D_6$ constitute another signal line set "$\mathbf{15}_2$." In other words, the signal line sets $\mathbf{15}_1$ are composed of the signal lines used to drive the pixels associated with the pixel sets "$P_{n1}$", whereas the signal line sets $\mathbf{15}_2$ are composed of the signal lines used to drive the pixels associated with the pixel sets "$P_{n2}$."

The structure of the driver 20 is almost identical to that of the display device shown in FIG. 1. The driver 20 is provided with a shift register 21, a data register 22, a latch 23, a D/A converter 24, a set of amplifiers 25, and a control circuit 26. The driver 20 is designed to develop drive voltages on the input terminals 14 for driving the pixels within the liquid crystal display panel 10, and to provide control signals "$S_1$" to "$S_6$" to the switches $\mathbf{13}_1$ to $\mathbf{13}_6$. The control circuit 26 provides timing control for the switches $\mathbf{13}_1$ to $\mathbf{13}_6$ so as to synchronize the development of the drive voltages on the input terminals 14 with timing of the control signals $S_1$ to $S_6$. This allows the driver 20 to select the desired signal lines, and to provide desired drive voltages for the associated pixels through the selected signal lines. The control circuit executes the above-described timing control in accordance with a program stored in a storage apparatus (not shown) of the driver 20.

Principle of the Display Panel Drive Technique in this Embodiment

The display panel driving method in this embodiment is based on a fact that the spectral luminous efficacy for human vision depends on colors, that is, the wavelengths of light. The spectral luminous efficacy for human vision exhibits the maximum value at a light wavelength of 555 nm, and decreases with the deference from the wavelength corresponding to the maximum spectral luminous efficacy.

The display panel driving method in this embodiment optimizes the sequence for driving three adjacent pixels within a single pixel set, associated with different colors, on the basis of the spectral luminous efficacy for human vision, and thereby reduces the deterioration of the image quality, which may result from the variation of the drive voltages across the pixels.

More specifically, the display panel driving method in this embodiment sequentially drives a set of three pixels within a specific pixel set as follows: the display panel driving method firstly drives the "B" pixel, associated with blue, exhibiting the lowest spectral luminous efficacy. This is followed by driving the "R" pixel, associated with red, exhibiting the second lowest spectral luminous efficacy. Finally, the "G" pixel, associated with green, exhibiting the highest spectral luminous efficacy, is then driven.

The effect of the above-explained display panel driving method is based on a fact that pixels driven at an earlier stage within the horizontal scanning period experience an increased variation of drive voltages. When the pixels $C_{n1}$, $C_{n2}$, . . . , $C_{n6}$ are driven in this order, for instance, the pixels $C_{n1}$ experience the largest variation in the drive voltages, and the pixels $C_{n2}$ experience the second largest variation.

On the other hand, the magnitudes of the effects of the drive voltage variations within the pixels for human vision depend on the colors associated with the pixels; even if a pair of pixels associated with different colors experience the same variation in the drive voltage, the magnitudes of the effects for human vision are different depending on the associated colors. More specifically, "B" pixels associated with blue, exhibiting the lowest spectral luminous efficacy, cause the smallest effect for human vision. Accordingly, the variations in the drive voltages across the "B" pixels cause relatively reduced influence on the image quality. Conversely, "G" pixels associated with green, exhibiting the highest spectral luminous efficacy, cause the largest effect for human vision. Accordingly, the variations in the drive voltages across the G pixels cause considerable deterioration of the image quality.

On the basis of the above-described facts, the inventor has discovered that the deterioration of the image quality of the liquid crystal display panel 10 is suppressed through driving three pixels associated with different colors within a single pixel set in an order from low to high spectral luminous efficacies for human vision, that is, in this order from "B" pixel, "R" pixel, and "G" pixel. Driving a "B" pixel at an earlier stage, for example, may cause a considerable variation in the drive voltage thereacross; however, this does not matter, because of the reduced spectral luminous efficacy of the "B" pixel. On the other hand, driving a "G" pixel at a final stage is effective for achieving improved image quality; this effectively suppresses the variation in the drive voltage across the "G" pixel, exhibiting the highest spectral luminous efficacy.

This technical concept is applicable to any color systems other than the RGB color system. For example, the present technical concept may be applied to such a display panel adapted to color systems defining colors as mixtures of four, or more elementary colors, including an RGBB color system, and an RGBW color system. Driving pixels associated with different colors in the order from low to high spectral luminous efficacies effectively suppress the deterioration of the image quality resulting from the variation in the drive voltages across the pixels.

Display Panel Driving Sequence

FIGS. 3A to FIG. 3C are tables illustrating exemplary sequences for writing drive voltages into the associated pixels. It should be noted that the order of driving the pixels corresponds to the order of selecting the switches $\mathbf{13}_1$ to $\mathbf{13}_6$, and also to the order of selecting the signal lines $D_1$ to $D_6$. As indicated in FIG. 3A to FIG. 3C, the sequence for writing the drive voltages into the pixels is determined in accordance with such a condition that the drive voltages are written to the three pixels within the single pixel set in the order from low to high spectral luminous efficacies.

Referring now to FIG. 3A, for instance, the pixels $C_{n1}$ to $C_{n6}$, positioned in the n-th pixel line, are driven with drive voltages during the n-th horizontal scanning period in the following order: the pixels $C_{n3}$, associated with blue "B", are firstly driven, and the pixels $C_{n6}$, also associated with blue "B", are secondly driven. This is followed by driving the "R" pixels $C_{n1}$, and then driving the "R" pixels $C_{n4}$. Subsequently, the pixels $C_{n2}$, associated with green, are driven, and finally, the "G" pixels $C_{n5}$, also associated with green, are driven.

For the pixels $C_{(n+1)1}$ to $C_{(n+1)6}$, positioned in the (n+1)-th pixel line, the "B" pixels $C_{(n+1)6}$ are firstly driven, and the "B" pixels $C_{(n+1)3}$ are secondly driven. This is followed by driving the "R" pixels $C_{n4}$, and then driving the "R" pixels $C_{n1}$. The "G" pixels $C_{n5}$ are then driven, and finally, the "G" pixels $C_{n2}$, are driven.

If an attention is paid only to the "R" pixels $C_{n1}$ the "G" pixels $C_{n2}$, and the "B" pixel $C_{n3}$, which belong to the pixel sets $P_{n1}$ in the n-th pixel line, the drive voltages are written thereto in this order of the "B" pixels $C_{n3}$, the "R" pixels $C_{n1}$, and the "G" pixels $C_{n2}$. The same goes for the pixel sets $P_{n2}$, and the pixel sets $P_{(n+1)1}$ and $P_{(n+1)2}$, positioned in the (n+1)-th pixel line.

More specifically, the drive sequence for driving the pixels $C_{n1}$ to $C_{n6}$, and $C_{(n+1)1}$ to $C_{(n+1)6}$, which is shown in FIG. 3A, is performed as follows: Referring to FIG. 2, the scan line $G_n$, connected to the pixels $C_{n1}$ to $C_{n6}$ in the n-th pixel line, is activated to turn on the TFTs 11 within the pixels $C_{n1}$ to $C_{n6}$. This provides electrical connections between the pixels $C_{n1}$ to $C_{n6}$ and the associated signal lines $D_1$ to $D_6$.

Subsequently, the drive voltages $V_{n3}$ associated with the "B" pixels $C_{n3}$ of the pixel sets $P_{n1}$ are applied from the amplifiers 25 to the associated input terminals 14. In synchronism with the input of the drive voltages $V_{n3}$, the switches $\mathbf{13}_3$ are turned on, and the remaining switches 13 are turned off. This achieves electrical connection between the signal lines $D_3$ and the input terminals 14, and disconnects the remaining signal lines from the input terminals 14. The drive voltages $V_{n3}$ are applied via the signal lines $D_3$ to the "B" pixels $C_{n3}$, and the drive voltages $V_{n3}$ are written into the "B" pixels $C_{n3}$.

This is followed by providing the drive voltages $V_{n6}$, associated with the "B" pixels $C_{n6}$ of the pixel set $P_{n2}$, on the input terminals 14 from the amplifier 25. In synchronism with the input of the drive voltages $V_{n6}$, the switches $\mathbf{13}_6$ are turned on and the remaining switches 13 are turned off. As a result, the input terminals 14 are connected to the signal lines $D_6$, and the drive voltages $V_{n6}$ are written into the "B" pixels $C_{n6}$ via the signal line $D_6$.

Correspondingly, the drive voltages $V_{n1}$, $V_{n4}$, $V_{n2}$, $V_{n5}$ to be written into the "R" pixels $C_{n1}$, the "R" pixels $C_{n4}$, the "G" pixels $C_{n2}$, and the "G" pixels $C_{n5}$, respectively, are sequentially supplied from the amplifiers 25 to the input terminals 14. In synchronism with the supplies of these drive voltages, the switches $\mathbf{13}_1$, $\mathbf{13}_4$, $\mathbf{13}_2$, and $\mathbf{13}_5$ are sequentially turned on. As a result, the drive voltages $V_{n1}$ $V_{n4}$, $V_{n2}$, $V_{n5}$ are sequentially written into the "R" pixels $C_{n1}$, the "R" pixels $C_{n4}$, the "G" pixels $C_{n2}$, and the "G" pixels $C_{n5}$ via the signal lines $D_1$, $D_4$, $D_3$, and $D_5$.

This completes the time-divisional drive of the signal lines $D_1$ to $D_6$ using the amplifiers 25, so that the drive voltages $V_{n1}$ to $V_{n6}$ are written to the pixels $C_{n1}$ to $C_{n6}$, respectively in the n-th horizontal period.

The same goes for the (n+1)-th horizontal period, subsequent to the n-th horizontal period in exception that the order of driving the pixels is different. Those skilled in the art would appreciate the detailed procedure for driving the pixels $C_{(n+1)1}$ to $C_{(n+1)6}$, positioned in the (n+1)-th pixel line.

Preferably, the order of driving the pixels is switched for every pixel line in unit of pixel sets. In other words, the orders of driving the pixels positioned in adjacent pixel lines are preferably exchanged in units of pixel sets. This effectively improves the image quality of the liquid crystal display panel 10.

Specifically, each pixel within the pixel sets $P_{n1}$, positioned in the n-th pixel line, is given priority over the corresponding pixel within the pixel sets $P_{n2}$, positioned in the n-th pixel line, while each pixel within the pixel sets $P_{(n+1)2}$ are given priority over the corresponding pixel within the pixel sets $P_{(n+1)1}$. For the n-th pixel line, for instance, the "B" pixels $C_{n3}$ within the pixel sets $P_{n1}$ are driven prior to the corresponding "B" pixels $C_{n6}$ within the pixel set $P_{n2}$, while the "B" pixels $C_{(n+1)6}$ within the pixel sets $P_{(n+1)2}$ is given priority over the "B" pixels $C_{(n+1)3}$ within the pixel sets $P_{(n+1)1}$ for the (n+1)-th pixel line.

This drive sequence is explained more specifically in the following, using "ordering numbers" defined for the respective pixels, the ordering numbers being integers ranging from one to six. A set of ordering numbers indicate the order of driving associated six pixels within each pixel line; the pixels are driven in the order from small to large ordering numbers. With thus-defined ordering numbers, the orders of driving the pixels $C_{n1(n+1)}$ to $C_{n6}$, positioned in the n-th pixel line, and the pixels $C_{(n+1)1}$ to $C_{(n+1)6}$, positioned in the (n+1)-th pixel line are preferably determined so as to satisfy the following equations:

$$\alpha_{(n+1)1} = \alpha_{n4}, \quad (1\text{-}1)$$
$$\alpha_{(n+1)2} = \alpha_{n5}, \quad (1\text{-}2)$$
$$\alpha_{(n+1)3} = \alpha_{n6}, \quad (1\text{-}3)$$
$$\alpha_{(n+1)4} = \alpha_{n1}, \quad (1\text{-}4)$$
$$\alpha_{(n+1)5} = \alpha_{n6}, \text{ and} \quad (1\text{-}5)$$
$$\alpha_{(n+1)6} = \alpha_{n1}, \quad (1\text{-}6)$$

where $a_{i1}$, $a_{i2}$ and $a_{i3}$ are the ordering numbers associated with pixels $C_{i1}$, $C_{i2}$, and $C_{i3}$ of the pixel sets $P_{i1}$ positioned in the i-th line, and $a_{i4}$, $a_{i5}$, and $a_{i6}$ are the ordering numbers associated with pixels $C_{i4}$, $C_{i5}$, and $C_{i6}$ of the pixel sets $P_{i2}$; the ordering numbers $\alpha_{i1}$, $\alpha_{i2}$, $\alpha_{i3}$, $\alpha_{i4}$, $\alpha_{i5}$, and $\alpha_{i6}$ are different integers ranging from one to six.

The equations (1-1) to (1-6) implies that the ordering numbers of the pixels within the pixel sets $P_{n1}$, positioned in the n-th pixel line, are identical to the ordering numbers of the pixels within the pixel sets $P_{(n+1)2}$, positioned in the (n+1)-th pixel line, and that the ordering numbers of the pixels within the pixel sets $P_{n2}$, positioned in the n-th pixel line, are identical to the ordering numbers of the pixels within the pixel sets $P_{(n+1)1}$, positioned in the (n+1)-th pixel line.

For the drive sequence shown in FIG. 3A, for example, it holds:

$\alpha_{n1}=3$,
$\alpha_{n2}=5$,
$\alpha_{n3}=1$,
$\alpha_{n4}=4$,
$\alpha_{n5}=6$,
$\alpha_{n6}=2$,
$\alpha_{(n+1)1}=\alpha_{n4}=4$,
$\alpha_{(n+1)2}=\alpha_{n5}=6$, $\alpha_{(n+1)3}=\alpha_{n6}=2$,
$\alpha_{(n+1)4}=\alpha_{n1}=3$,
$\alpha_{(n+1)5}=\alpha_{n2}=5$, and
$\alpha_{(n+1)6}=\alpha_{n3}=1$.

This driving sequence spatially distributes the pixels experiencing the drive voltages thereacross, and thereby effectively eliminates vertical segments of uneven brightness. Those skilled in the art would appreciate that this argument would be applied to the drive sequences shown in FIGS. 3B and 3C.

As represented in FIG. 3A and FIG. 3B, the ordering numbers of the "G" pixels $C_{i2}$ and $C_{i5}$ are preferably selected from 5 and 6 for each pixel line; in other words, for the six pixels connected to the same input terminal 14, the "G" pixels $C_{i2}$ and $C_{i5}$ are preferably driven after the remaining pixels $C_{i1}$, $C_{i3}$, $C_{i4}$ and $C_{i6}$ are driven. It should be noted that the driving sequence shown in FIG. 3C, which is in the scope of the present invention, does not satisfy this requirement.

For the exemplary driving sequences shown in FIGS. 3A and 3B, for instance, the "G" pixels $C_{n2}$ are fifthly driven, and the "G" pixels $C_{n5}$ are sixthly driven for the n-th pixel line. For the (n+1)-th pixel line, the "G" pixel $C_{(n+1)2}$ are sixthly driven, and the "G" pixel $C_{(n+1)5}$ are fifthly driven.

Such driving sequence is effective for achieving desired brightness on the liquid crystal display panel 10. The brightness of the liquid crystal display panel 10 is most influenced by the grayscale levels of the "G" pixels associated with green, exhibiting the highest spectral luminous efficacy. Accordingly, driving the "G" pixels $C_{i2}$ and $C_{i5}$ at the last effectively suppresses the variation in the drive voltages thereacross, and effectively achieves the desired brightness on the liquid crystal display panel 10.

In addition, as illustrated in FIGS. 4A, 4B, 5A, 5B, 6A, and 6B, the drive sequence for writing the drive voltages is preferably switched for every pixel line and every frame; this is effective for further improving the image quality of the liquid crystal display panel 10.

Specifically, for the m-th frame, the ordering numbers of the pixels $C_{n1}$ to $C_{n3}$ within the pixel sets $P_{n1}$, positioned in the n-th pixel line, are identical to the ordering numbers of the pixels $C_{(n+1)4}$ to $C_{(n+1)6}$ within the pixel sets $P_{(n+1)2}$, positioned in the (n+1)-th pixel line, and the ordering numbers of the pixels $C_{n4}$ to $C_{n6}$ within the pixel sets $P_{n2}$, positioned in the n-th pixel line, are identical to the ordering numbers of the pixels $C_{(n+1)1}$ to $C_{(n+1)3}$ within the pixel sets $P_{(n+1)1}$, positioned in the (n+1)-th pixel line.

For the (m+1)-th frame, following the m-th frame, the ordering numbers are exchanged between the adjacent pixel sets in the same pixel line; the ordering numbers of the pixels $C_{n1}$ to $C_{n3}$ within the pixel sets $P_{n1}$ for the (m+1)-th frame are identical to those of the pixels $C_{n4}$ to $C_{n6}$ within the pixel sets $P_{n2}$ for the m-th frame, and the ordering numbers of the pixels $C_{n4}$ to $C_{n6}$ within the pixel sets $P_{n2}$ for the (m+1)-th frame are identical to those of the pixels $C_{n1}$ to $C_{(n+1)3}$ within the pixel sets $P_{n1}$ for the m-th frame. Additionally, the ordering numbers of the pixels $C_{(n+1)1}$ to $C_{(n+1)3}$ within the pixel sets $P_{(n+1)1}$ for the (m+1)-th frame are identical to those of the pixels $C_{(n+1)4}$ to $C_{(n+1)6}$ within the pixel sets $P_{(n+1)2}$ for the m-th frame, and the ordering numbers of the pixels $C_{(n+1)4}$ to $C_{(n+1)6}$ within the pixel sets $P_{n2}$ for the (m+1)-th frame are identical to those of the pixels $C_{(n+1)1}$ to $C_{(n+1)3}$ within the pixel sets $P_{(n+1)1}$ for the m-th frame.

Such driving sequences are repeated for the following frames after the m-th and (m+1)-th frames.

The afore-mentioned driving sequences for m-th and (m+1)-th frames are described more specifically, using the ordering numbers defined for the respective pixels. The orders of driving the pixels $C_{n1(n+1)}$ to $C_{n6}$, positioned in the n-th pixel line, and the pixels $C_{(n+1)1}$ to $C_{(n+1)6}$, positioned in the (n+1)-th pixel line are preferably determined so as to satisfy the following equations:

| | |
|---|---|
| $\alpha^m_{(n+1)1} = \alpha^m_{n4}$, | (2-1) |
| $\alpha^m_{(n+1)2} = \alpha^m_{n5}$, | (2-2) |
| $\alpha^m_{(n+1)3} = \alpha^m_{n6}$, | (2-3) |
| $\alpha^m_{(n+1)4} = \alpha^m_{n1}$, | (2-4) |
| $\alpha^m_{(n+1)5} = \alpha^m_{n2}$, | (2-5) |
| $\alpha^m_{(n+1)6} = \alpha^m_{n3}$, | (2-6) |
| $\alpha^{m+1}_{n1} = \alpha^m_{n4}$, | (3-1) |
| $\alpha^{m+1}_{n2} = \alpha^m_{n5}$, | (3-2) |
| $\alpha^{m+1}_{n3} = \alpha^m_{n6}$, | (3-3) |
| $\alpha^{m+1}_{n4} = \alpha^m_{n1}$, | (3-4) |
| $\alpha^{m+1}_{n3} = \alpha^m_{n2}$, | (3-5) |
| $\alpha^{m+1}_{n4} = \alpha^m_{n3}$, | (3-6) |
| $\alpha^{m+1}_{(n+1)1} = \alpha^m_{n1}$, | (4-1) |
| $\alpha^{m+1}_{(n+1)2} = \alpha^m_{n2}$, | (4-2) |
| $\alpha^{m+1}_{(n+1)3} = \alpha^m_{n3}$, | (4-3) |
| $\alpha^{m+1}_{(n+1)4} = \alpha^m_{n4}$, | (4-4) |
| $\alpha^{m+1}_{(n+1)5} = \alpha^m_{n5}$, and | (4-5) |
| $\alpha^{m+1}_{(n+1)6} = \alpha^m_{n6}$, | (4-6) |

where $\alpha^k_{i1}$, $\alpha^k_{i2}$, $\alpha^k_{i3}$, $\alpha^k_{i4}$, $\alpha^k_{i5}$, and $\alpha^k_{i6}$ are the ordering numbers of the pixels $C_{i1}$, $C_{i2}$, $C_{i3}$, $C_{i4}$, $C_{i5}$, and $C_{i6}$, positioned in i-th pixel line, for the m-th frame, respectively; the ordering numbers $\alpha^k_{i1}$, $\alpha^k_{i2}$, $\alpha^k_{i3}$, $\alpha^k_{i4}$, $\alpha^k_{i5}$, and $\alpha^k_{i6}$ are different integers ranging from one to six.

In this case, the ordering numbers of the "G" pixels $C_{i2}$ and $C_{i5}$ are preferably selected from 5 and 6 for each pixel line, as shown in FIGS. 4A, 4B, 5A, and 5B; in other words, for the six pixels connected to the same input terminal 14, the "G" pixels $C_{i2}$ and $C_{i5}$ are preferably driven after the remaining pixels $C_{i1}$, $C_{i3}$, $C_{i4}$, and $C_{i6}$ are driven. This effectively achieves the desired brightness on the liquid crystal display panel 10.

SUMMARY AND SUPPLEMENT

In summary, the display panel driving technique presented in this embodiment drives the pixels within a single pixel set in the order from low to high spectral luminous efficacies of the colors associated therewith. This effectively reduces the deterioration of the image quality of the liquid crystal display panel 10, resulting from the variation in the drive voltages across the pixels.

Preferably, the drive sequences for driving the pixels are switched every line and/or every frame in units of pixel sets, so that the image quality of the liquid crystal display panel 10 can be further improved.

Although the invention has been described in its preferred form with a certain degree of particularity, it is understood that the present disclosure of the preferred form has been changed in the details of construction and the combination and arrangement of parts may be resorted to without departing from the scope of the invention as hereinafter claimed.

Especially, it should be understood that the number of the signal line sets 15 connected to each input terminal 14 is not limited to 2. Similarly to FIG. 1, the number of signal lines which are connected to one input terminal 14 may be three; in other words, the signal line set may be connected to each input terminal 14. Alternatively, three or more signal line sets 15 may be connected to each input terminal 14.

Additionally, those skilled in the art would appreciate that the distribution of components between the liquid crystal display panel 10 and the driver 20 may be modified. For instance, the switches $\mathbf{13}_1$ to 136 may be mounted on the driver 20 instead of the liquid crystal display panel 10. It should be noted, however, the arrangement of FIG. 2 in which the switches $\mathbf{13}_1$ to $\mathbf{13}_6$ are mounted on the liquid crystal display panel 10 is suitable in order to reduce a total number of the wiring lines which electrically connect the liquid crystal display panel 10 to the driver 20.

What is claimed is:

1. A method of driving a display device including first to p-th pixels associated with different colors with p being integers equal to or more than three, a node receiving drive voltages associated with said first to p-th pixels, and first to p-th switches connected between said node and said first to p-th pixels, respectively, said first to p-th pixels being connected to a same scan line, said method comprising:

time-divisionally driving said first to p-th pixels, wherein said time-divisionally driving includes firstly driving selected one of said first to p-th pixels, said selected one being associated with a color exhibiting the lowest spectral luminous efficacy among said colors, and the first to p-th pixels are time-divisionally driven in a same horizontal scanning period.

2. The method according to claim 1, wherein said first to p-th pixels are driven in the order from low to high spectral luminous efficacies of said associated colors.

3. The method according to claim 1, wherein said display device further includes:

a node receiving drive voltages associated with said first to p-th pixels, and first to p-th switches connected between said node and said first to p-th pixels, respectively, and wherein said time-divisionally driving includes controlling said first to p-th switches so that said selected one of said first to p-th pixels, associated with the color exhibiting the lowest spectral luminous efficacy, is firstly driven during said same horizontal scanning period.

4. The method according to claim 3, wherein said first to p-th switches each comprise at least one TFT disposed within a display panel.

5. The method according to claim 3, wherein said display device further includes:

first to p-th signal lines through which said first to p-th switches are connected to said first to p-th pixels, respectively.

6. The method according to claim 3, wherein said first to p-th switches are sequentially turned on during said same horizontal scanning period in the order of from low to high spectral luminous efficacies associated therewith.

7. The method according to claim 1, wherein first to p-th pixels includes a set of "R", "G", and "B" pixels associated with red, green, and blue, respectively, and wherein said "B" pixel is firstly driven among said "R", "G", and "B" pixels.

8. The method according to claim 7, wherein said "R", "G", and "B" pixels are driven in this order of said "B" pixel, said "R" pixel, and said "G" pixel.

9. A method of driving a display device including a plurality of pixel lines each of which includes first to p-th pixels associated with different colors with p being integers equal to or more than three, said first to p-th pixels being connected to a same scan line, said method comprising:

time-divisionally driving said first to p-th pixels included in selected one of said plurality of pixel lines with associated drive voltages, wherein with respect to all the pixel lines, said time-divisionally driving includes finally driving selected one of said first to p-th pixels, said selected one being associated with a color exhibiting the highest spectral luminous efficacy among said colors, and the first to p-th pixels are time-divisionally driven in a same horizontal scanning period.

10. The method according to claim 9, wherein said display device further includes:

a node receiving drive voltages associated with said first to p-th pixels, and first to p-th switches connected between said node and said first to p-th pixels, respectively, and wherein said time-divisionally driving includes controlling said first to p-th switches so that said selected one of said first to p-th pixels, associated with the color exhibiting the highest spectral luminous efficacy, is finally driven during said same horizontal scanning period.

11. The method according to claim 10, wherein said display device further includes:

first to p-th signal lines through which said first to p-th switches are connected to said first to p-th pixels, respectively.

12. The method according to claim 9, wherein said first to p-th pixels includes a set of "R", "G", and "B" pixels associated with red, green, and blue, respectively, and wherein said "G" pixel is finally driven among said "R", "G", and "B" pixels.

13. A driver for driving a display panel including an input, first to p-th pixels associated with first to p-th colors, respectively, p being an integer equal to or more than three, said first to p-th pixels being connected to a same scan line, first to p-th signal lines connected to said first to p-th pixels, respectively, and first to p-th switches connected between said input and said first to p-th signal lines, associated with said first to p-th colors, respectively, said driver comprising:

a drive voltage generator circuitry developing first to p-th drive voltages to be applied to said first to p-th pixels, respectively, and a control circuit developing first to p-th control signals for controlling said first to p-th switches, respectively, wherein said control circuit controls said drive voltage generator circuitry to sequentially develop said first to p-th drive voltages on said input during a horizontal scanning period, and develops said first to p-th control signals to turn on said first to p-th switches in synchronism with development of associated ones of said first to p-th drive voltages on said input, and wherein said first to p-th control signals and said first to p-th drive voltages are developed so that selected one of said first to p-th switches is firstly turned on during said horizontal scanning period, said selected one being associated with a color exhibiting the lowest spectral luminous efficacy among said colors, and the first to p-th pixels are configured to be time-divisionally driven in a same horizontal scanning period.

14. The driver according to claim 13, wherein said first to p-th control signals and said first to p-th drive voltages are developed so that said first to p-th switches are turned on during said same horizontal scanning period in the order from low to high spectral luminous efficacies with which said first to p-th switches are associated.

15. The method according to claim 1, wherein the firstly-driven pixel experiences considerable variation in the drive voltage thereacross, and wherein the firstly-driven pixel exhibits a reduced influence on image quality due to the lowest spectral luminous efficacy.

16. The method according to claim 9, wherein a firstly-driven pixel experiences considerable variation in the drive voltage thereacross, and wherein the firstly-driven pixel exhibits a reduced influence on image quality due to a lowest spectral luminous efficacy.

17. The driver according to claim 13, wherein the driver is configured so that a firstly-driven pixel experiences considerable variation in the drive voltage thereacross, and wherein the firstly-driven pixel exhibits a reduced influence on image quality due to the lowest spectral luminous efficacy.

18. The driver according to claim 13, wherein the driver is configured so that first to p-th pixels include a set of "R", "G", and "B" pixels associated with red, green, and blue, respectively, and wherein said "B" pixel is firstly driven among said "R", "G", and "B" pixels.

19. The driver according to claim 18, wherein the driver is configured so that said "R", "G", and "B" pixels are driven in this order of said "B" pixel, said "R" pixel, and said "G" pixel.

* * * * *